United States Patent [19]

Pearson

[11] 4,166,298

[45] Sep. 4, 1979

[54] DEODORIZER FOR TOILETS

[76] Inventor: Raymond H. Pearson, 627 Sherwood Dr., Richardson, Tex. 75080

[21] Appl. No.: 869,815

[22] Filed: Jan. 16, 1978

Related U.S. Application Data

[63] Continuation-in-part of Ser. No. 742,218, Nov. 15, 1976, abandoned, which is a continuation-in-part of Ser. No. 659,961, Feb. 20, 1976, abandoned.

[51] Int. Cl.[2] ..... A47K 3/22; E03D 9/04; E03D 13/00

[52] U.S. Cl. ..... 4/213

[58] Field of Search ..... 4/213, 216, 209

[56] References Cited

U.S. PATENT DOCUMENTS

| | | | |
|---|---|---|---|
| 2,297,935 | 10/1942 | Baither | 4/213 |
| 2,985,890 | 5/1961 | Baither | 4/213 |
| 3,763,505 | 10/1973 | Zimmerman | 4/213 |
| 3,781,923 | 1/1974 | Maisch et al. | 4/213 |
| 4,031,574 | 6/1977 | Werner | 4/213 |

*Primary Examiner*—Henry K. Artis

*Attorney, Agent, or Firm*—Strauch, Nolan, Neale, Nies & Kurz

[57] ABSTRACT

A toilet deodorizer having a hollow housing, containing a motor-driven fan and a filter medium, mounted within the normal flush tank air chamber. The housing divides the air chamber into an intake receptacle, inside the housing, and an exhaust receptacle, outside the housing. The intake receptacle is open to the overflow conduit through an inlet aperture, and is open to the exhaust receptacle through an outlet aperture. The fan induces air from the closet bowl through the overflow conduit, and thence through the filter into the exhaust chamber, thereby deodorizing the closet bowl.

2 Claims, 2 Drawing Figures

DEODORIZER FOR TOILETS

CROSS REFERENCE TO RELATED APPLICATIONS

This application is a continuation-in-part of my pending application Ser. No. 742,218, now abandoned filed Nov. 15, 1976, which is in turn a continuation-in-part of my original application Ser. No. 659,961, now abandoned filed Feb. 20, 1976. The original application was abandoned in favor of continuations-in-part. The present invention has been taught continuously in the original application and in the continuations, but is claimed only in the present application.

BRIEF SUMMARY OF THE INVENTION

The present invention relates to a deodorizer for a conventional water closet comprising a closet bowl and a flush tank having a flush valve and overflow conduit in fluid communication with the closet bowl. More particularly, the invention relates to a deodorizer which is contiguous to the flush tank, and which has some type of odor filter to deodorize the odorous air induced from the closet bowl.

The prior art teaches a first class of deodorizer which utilizes the flush tank air chamber as an odorous air intake receptacle. The deodorizer includes a fan which reduces the air pressure of the intake receptacle below ambient, so that odorous air is induced from the closet bowl through the overflow conduit into the intake receptacle and thence into the deodorizer. The deodorized air is discharged into ambient atmosphere.

The prior art teaches a second class of deodorizer which utilizes the flush tank air chamber as a deodorized air exhaust receptacle. Odorous air is induced into the deodorizer through a special air duct from the toilet seat or closet bowl. The deodorized air is discharged into the exhaust receptacle.

The first class of deodorizer is characterized by a seal between the flush tank and its cover, and by a special hollow flush tank cover, or other exterior appendage, in which the deodorizer is disposed. Some deodorizers of this class require holes to be drilled in the flush tank. The second class of deodorizer is characterized by a special water tank having a compartment in which the deodorizer is disposed, in addition to the special exterior air duct to the closet bowl or toilet seat. A good seal between the flush tank and its cover is difficult to achieve, because existing flush tanks were specifically designed to avoid such a seal, the seal retarding the flushing cycle. Special hollow flush tank covers are expensive, may neither fit nor match existing flush tanks and affect the appearance of the water closet, being of abnormal size. Special flush tanks are expensive, may neither fit nor match existing closet bowls, and the special air duct interrupts the usually easily cleaned surfaces of the water closet. It will be shown that the present invention avoids these disadvantages.

In its broader aspects, the present invention contemplates a toilet deodorizer which includes a hollow housing adapted inside an otherwise normal flush tank so as to partition the normal flush tank air chamber into an intake receptacle, inside the housing, disposed within an exhaust receptacle, outside the housing. The intake receptacle is open to the overflow conduit. A fan is carried in the housing to reduce the air pressure of the intake receptacle and raise the air pressure of the exhaust receptacle, thereby inducing air from the closet bowl, through the overflow conduit into the intake receptacle, and thence into the exhaust receptacle. A filter, in seriatim with the fan, deodorizes the air induced into the exhaust receptacle. The partitioning of the normal air chamber into an intake receptacle disposed within an exhaust receptacle is the novel method by which the present invention avoids the disadvantages of the prior art, set forth previously. The invention may be practiced in many ways, there being many ways to construct a housing which partitions the flush tank according to the present invention.

An object of this invention is to reduce the cost and difficulty of adding a deodorizer to a conventional water closet.

Another object of this invention is to provide a deodorizer which may be adapted to a normal water closet flush tank without significantly altering its appearance.

A further object of this invention is to provide a deodorizer which may be adapted to a normal water closet without replacing the flush tank or flush tank cover.

Another object of this invention is to provide a deodorizer which may be adapted to a normal water closet without sealing the flush tank cover to the flush tank.

A further object of this invention is to provide a deodorizer which may be adapted to a normal flush tank without drilling special holes in the tank.

Other objects, features, advantages and results will become apparent from the following specification, when read in conjunction with the accompanying drawings.

DETAILED DESCRIPTION OF THE INVENTION

Figure 1:
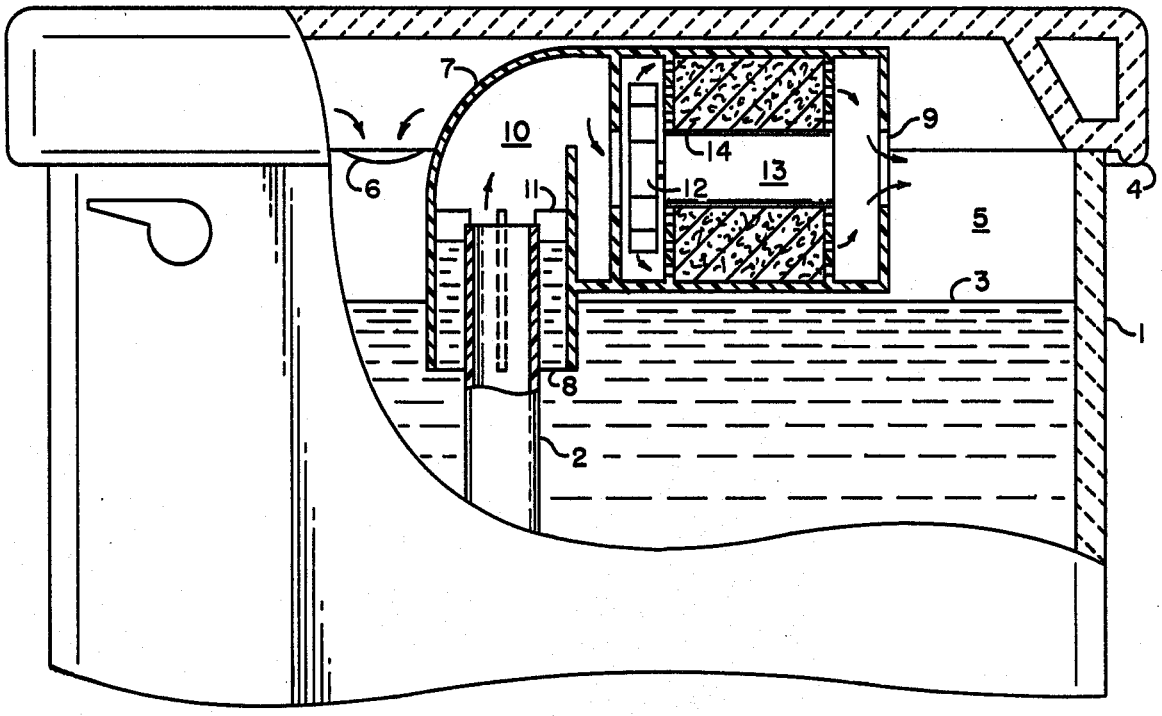
FIG. 1 is a front elevation view, partially in section, showing a normal flush tank adapted with a deodorizer according to the present invention.

In FIG. 1, I have shown the deodorizer as described in the original application, except I have not shown the manometric adapter taught therein. Only the upper portion of the flush tank 1 is illustrated, the construction of water closets being well understood in the art. It will be understood that the flush tank 1 is conventionally connected to a closet bowl through a flush valve, and that the flush tank 1 includes a fill valve and after-fill tube, which are not shown. An overflow conduit 2 is also in fluid communication with the closet bowl, in the conventional manner.

The flush tank 1 is filled with water to a predetermined quiescent level 3. The removable flush tank cover 4 cooperates with the walls of the flush tank 1, and with the water 3, to define a normal air chamber 5 above the quiescent water level 3. A vent 6 vents the air chamber 5 to ambient atmosphere. The vent 6 may be one or more cut-outs, as shown, or more commonly just a poor fit between the flush tank 1 and cover 4. All conventional flush tanks 1 have some sort of vent 6 to prevent a partial vacuum in the air chamber 5 when the closet bowl is flushed.

A hollow housing 7, having an inlet aperture 8 and an outlet aperture 9, partitions the air chamber 5 into an intake receptacle 10, defined by the housing 7, disposed within an exhaust receptacle 5, coincident with the air chamber 5 outside the housing 7. The intake receptacle 10 is open to the overflow conduit 2, through the inlet aperture 8, and water 3 rises into the housing 7, sealing the housing 7 to the overflow conduit 2. A plurality of undercut projections 11 support the housing 7 on the overflow conduit 2. Water 3, above the desired overflow level of the tank 1, is free to flow through the inlet aperture 8 into the overflow conduit 2. A centrifugal fan wheel 12, driven by an electric motor 13, is interposed between the intake receptacle 10 and the outlet aperture 9. Electrical controls for deodorizers are taught in the art. The fan wheel 12 reduces the air pressure of the intake receptacle 10 below ambient atmospheric pressure, inducing odorous air from the closet bowl, through the overflow conduit 2 into the intake receptacle 10. Arrows designate the air flow. The odorous air is discharged from the fan wheel 12 through an activated charcoal adsorptive filter 14. Deodorized air is discharged from the housing 7, through the outlet aperture 9 into the exhaust receptacle 5. Inasmuch as the air pressure of the exhaust receptacle 5 is raised slightly above ambient, the deodorized air exits the flush tank 1 through the vent 6 into ambient atmosphere adjacent the water closet.

Figure 2:
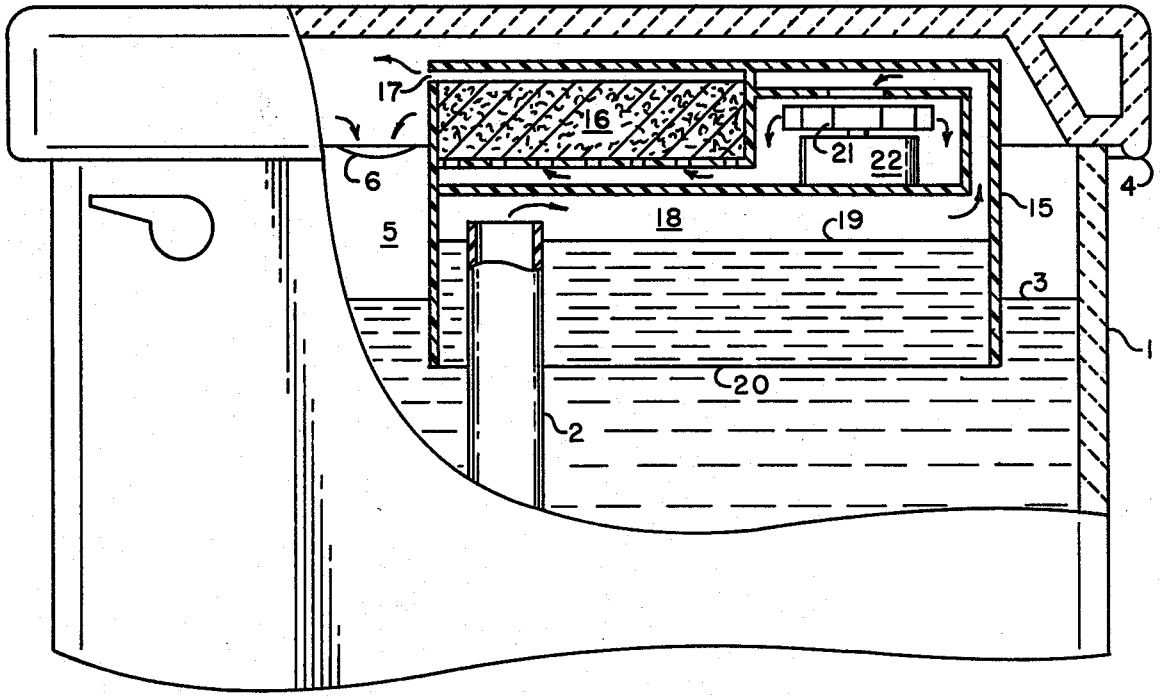
FIG. 2 is a front elevation view, partially in section, showing a normal flush tank adapted with an alternate embodiment of the deodorizer according to the present invention.

In FIG. 2, I have illustrated an alternate embodiment having a large hood-like housing 15, in lieu of the smaller housing 7 described previously. The housing 15 is clipped to the back rim of the flush tank 1, so as to cover the overflow conduit 2 and depend into the water 3. An inlet aperture 20, fan wheel 21, motor 22, filter 16 and outlet aperture 17 are provided as before. This alternate embodiment functions exactly as the embodiment of FIG. 1, described previously. The fan wheel 21 reduces the air pressure of the intake receptacle 18, and raises the air pressure of the exhaust receptacle 5, resulting in the flow of air in seriatim from the closet bowl, through the overflow conduit 2, through the intake receptacle 18, through the fan 21, through the filter 16 and through the outlet aperture 17 into the exhaust receptacle 5. However, inasmuch as the intake receptacle 18 is of large area, the water 19 rising above the water 3, in response to the fan 21, will cause the water level 3 to drop appreciably. This allows the intake receptacle 18 to have a lower air pressure than the previous intake receptacle 10, before water reaches the top of the overflow conduit 2, providing better ventilation of the closet bowl. This results from the fact that the differential pressure between the exhaust receptacle 5 and the intake receptacle 18 corresponds exactly to the difference in altitude between the water level 19 and the water level 3.

The present invention is not to be construed as limited to the particular embodiments heretofore described, it being understood that changes may be made in the arrangement of parts set forth in this specification, and shown in the accompanying drawings, without departing from the principles, spirit and scope of the invention, as defined in the following claim.

What is claimed is:

1. The combination with a toilet including a closet bowl and a flush tank having an overflow conduit in fluid communication with said bowl and having a top cover cooperating with the walls of the tank and with the water in the tank to define an air chamber immediately above the quiescent level of said water to receive a body of air that is exposed to said water, said tank having at least one vent whereby said air chamber is vented to ambient atmosphere outside the tank; a hollow deodorizer housing formed separately of said tank and mounted in said tank below said cover to partition said air chamber into an odorous air intake compartment interiorly of said housing and an air exhaust compartment exteriorly of said housing, said air intake compartment being defined by interior wall surfaces of said housing, and said air exhaust compartment being delimited by the outside of the housing, by said tank and by said water, said housing having (a) an inlet aperture whereby said intake compartment is in fluid communication with said overflow conduit and (b) an outlet aperture whereby said intake compartment is in fluid communication with said exhaust compartment, a fan mounted in said housing between said inlet aperture and said outlet aperture, said fan being operable to induce air from said intake compartment into said exhaust compartment and to reduce the air pressure in the intake compartment below ambient atmospheric pressure and raise the air pressure of the exhaust compartment above ambient atmospheric pressure, and a filter mounted in said housing in seriatim with said fan so as to remove odors from the air induced into said exhaust compartment, said overflow conduit being in air communication with said exhaust compartment through said intake compartment, and said vent being in air communication with said exhaust compartment whereby air is induced from said bowl through said overflow conduit into said intake compartment, and thence through said filter into said exhaust compartment, and thence through said vent into ambient atmosphere, thereby deodorizing said closet bowl.

2. An air deodorizing unit for an existing toilet having a closet bowl, a flush tank including (a) a top cover cooperating with walls of the tank to define an air chamber immediately above and delimited by the quiescent level of the water in the tank and (b) at least one vent for venting said air chamber to the ambient atmosphere outside said tank, and an overflow conduit in fluid communication with said bowl and having an end received in and opening into said tank whereby air is allowed to flow from said bowl and through said overflow conduit, said air chamber and said vent to the exterior of said tank, said air deodorizing unit comprising a hollow housing formed independently of said tank and adapted to be mounted completely within said tank below said cover to partition said air chamber into an air intake compartment located interiorly of said housing and an air exhaust compartment located exteriorly of said housing in fluid communication with said vent and delimited by the surface of the water in said tank, said housing having (i) an inlet aperture located to place said intake compartment in fluid communication with said overflow conduit to enable air to flow from said conduit into said intake compartment and (ii) an outlet aperture located to open into said exhaust compartment to establish fluid communication between said intake and exhaust compartments for enabling air received in said intake compartment to flow into said exhaust compartment for passage through said vent, a fan disposed in said housing and operable to induce air in said overflow conduit to flow through said intake compartment and into said exhaust compartment, causing a reduction in the air pressure in said intake compartment and a rise in air pressure in said exhaust compartment, and an air filter disposed in said housing in seriatim with said fan for deodorizing the air flowing through said intake compartment and thereby providing for the discharge of deodorized air into said exhaust compartment for passage through said vent to the exterior of said tank.

* * * * *